United States Patent [19]

Roberts et al.

[11] 4,439,952

[45] Apr. 3, 1984

[54] PORTABLE GRINDER ASSEMBLY

[76] Inventors: Gary G. Roberts, 1412 Bryant, Newport, Ark. 72112; Calvin M. Swesey, 149 Glasgow Way, Vacaville, Calif. 95688

[21] Appl. No.: 313,863

[22] Filed: Oct. 22, 1981

[51] Int. Cl.[3] ..... B24B 19/14

[52] U.S. Cl. ..... 51/93; 51/224; 51/231; 51/240 R; 51/266; 51/269; 144/134 A; 144/134 R; 144/242 R

[58] Field of Search ..... 51/92 R, 92 BS, 93, 51/122, 134.5 F, 170 PT, 224, 231, 240 R, 240 A, 266, 268, 269; 144/134 R, 134 A, 134 D, 242 R; 409/134, 163, 164, 168, 224; 269/73, 71, 285; 83/398

[56] References Cited

U.S. PATENT DOCUMENTS

| | | | |
|---|---|---|---|
| 587,537 | 8/1897 | Van Norman | 51/240 A |
| 1,211,381 | 1/1917 | Alden | 51/93 X |
| 1,216,600 | 2/1917 | Paschall . | |
| 1,390,726 | 9/1921 | Scheiwer et al. | 51/92 R |
| 1,771,023 | 7/1930 | Allen . | |
| 1,783,618 | 12/1930 | Hoyt | 51/92 R |
| 2,002,938 | 5/1935 | Damser et al. | 51/240 R |
| 2,189,015 | 2/1940 | Maurer | 51/92 R |
| 2,393,463 | 1/1946 | Gottlieb | 51/170 PT X |
| 2,464,297 | 3/1949 | Ertl | 90/12 |
| 2,578,531 | 12/1951 | Flanders et al. | 51/84 |
| 2,714,337 | 8/1955 | Schultz | 51/240 A |
| 2,839,969 | 6/1958 | Anderson | 90/59 |
| 2,881,834 | 4/1959 | Thumim | 83/898 X |
| 3,463,137 | 8/1969 | Hare | 125/35 |
| 3,593,459 | 7/1971 | Kulischenko | 51/8 |
| 3,849,857 | 11/1974 | Murray, Jr. | 29/200 P |
| 3,901,295 | 8/1975 | Downing | 144/134 A X |
| 4,033,569 | 7/1977 | Dunn | 269/26 |
| 4,128,929 | 12/1978 | DeMusis | 29/156.8 B |

FOREIGN PATENT DOCUMENTS

| | | | |
|---|---|---|---|
| 2046637 | 3/1972 | Fed. Rep. of Germany | 51/268 |
| 289980 | 11/1931 | Italy | 51/92 |

*Primary Examiner*—Frederick R. Schmidt
*Assistant Examiner*—Robert P. Olszewski
*Attorney, Agent, or Firm*—Donald J. Singer; Jacob N. Erlich

[57] ABSTRACT

A portable grinder assembly for use in grinding oversized replacement stator vanes having a high speed air driven rotary carbide cutter situated adjacent a vane support. The vane support is capable of moving the vane in three predetermined directions with respect to the cutter. A tubular guard surrounds the cutter and not only directs cooling air on the cutter and vane during the grinding operation but also protects the operator of the grinder assembly from injury.

2 Claims, 3 Drawing Figures

FIG. 2
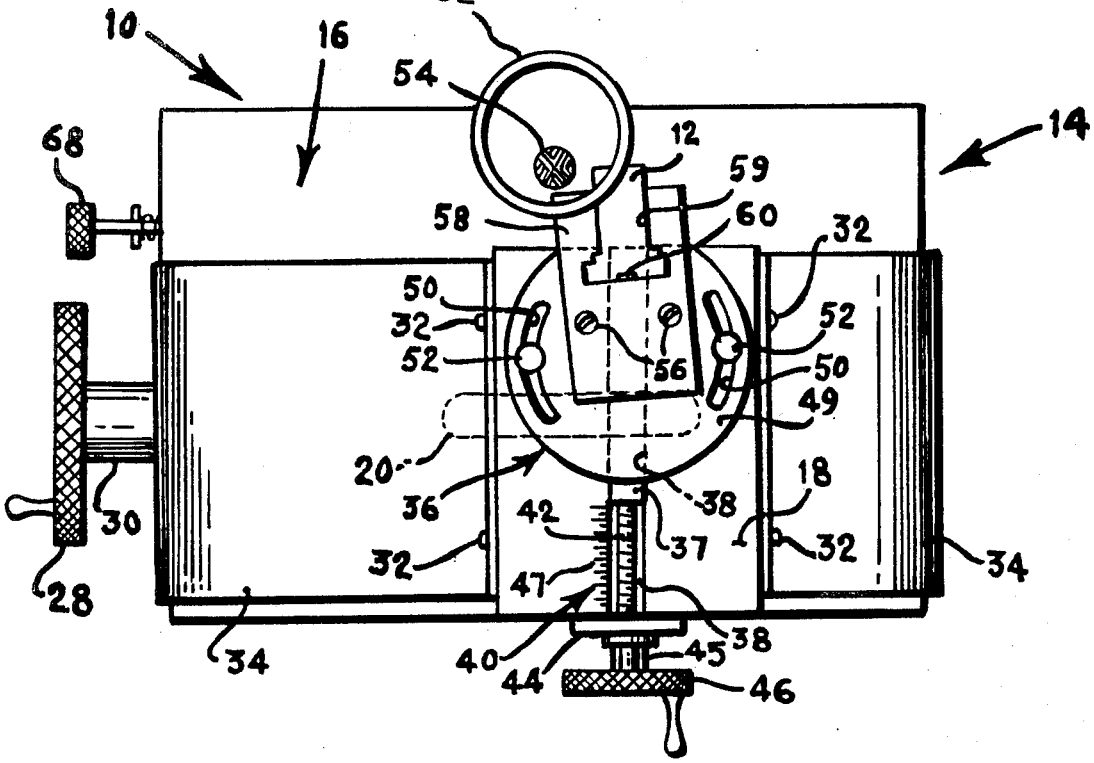
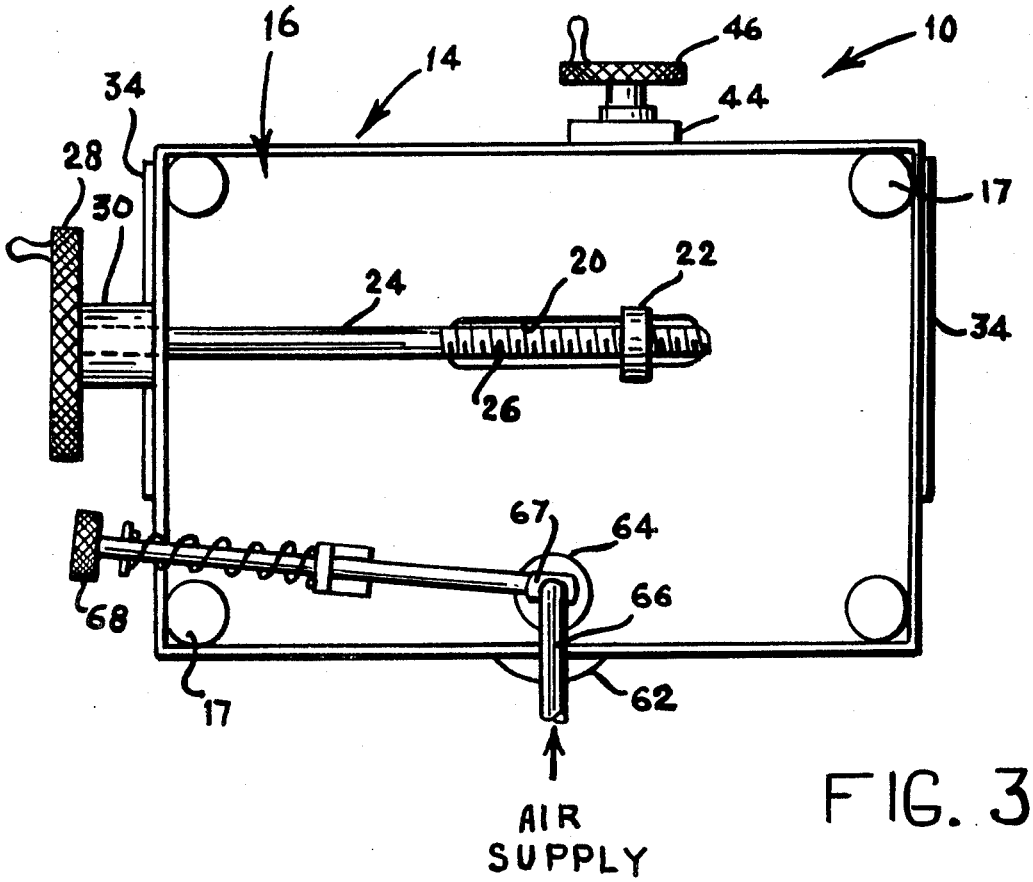
FIG. 3

PORTABLE GRINDER ASSEMBLY

STATEMENT OF GOVERNMENT INTEREST

The invention described herein may be manufactured and used by or for the Government for governmental purposes without the payment of any royalty thereon.

BACKGROUND OF THE INVENTION

This invention relates generally to the refurbishing of worn turbine components, and, more particularly to a portable grinder assembly for grinding replacement stator vanes to a particular angle.

A major component of turbine engines are the radially extending circularly arranged stator vanes. These circularly arranged stator vanes are supported at their outer ends by an air seal ring and at their inner ends by a suitable hub. Unfortunately, after a period of operation, the vanes utilized in turbine engines such as, for example, the TF-39 engine, tend to become worn, especially in the vicinity of the trailing edge of the airfoil surface.

In the past, the replacement vanes were sized to the appropriate dimensions by either filing by hand or the utilization of milling machines or belt sanders. As is quite evident, utilizing such techniques when replacing a large number of stator vanes (480 per engine) the above approaches prove to be extremely time consuming, tedious and in many instances unreliable. For example, the milling machine approach tends to grab the stator vane and destroy it. The use of the belt sander is even more disappointing since the required accuracy is difficult to achieve and belts must be constantly changed.

Another method of restoring worn turbine components is set forth in U.S. Pat. No. 4,128,929 issued on Dec. 12, 1978. In the above-mentioned patent a complex series of fixtures are utilized in order to successfully restore the worn turbine components. Such a procedure also leaves much to be desired, especially when the replacement of worn stator vanes are being performed in the field.

It is therefore clearly evident from the above description of prior attempts at stator vane refurbishment, that a great need exists for a grinding device for utilization in stator vane replacement which is capable of being operational in the field, reliable, economical to produce and efficient in operation.

SUMMARY OF THE INVENTION

The present invention overcomes the problems encountered in the past and as set forth in detail hereinabove by providing a portable grinder assembly for grinding replacement stator vanes.

The grinder assembly of this invention incorporates therein an air driven carbide cutter used in conjunction with an adjustable stator vane holder. In addition, a uniquely designed enclosure for the cutter serves both as a safety shield and as a duct to ensure that cooling air surrounds the cutting surface during operation thereof. The utilization of the portable grinder assembly of this invention greatly facilitates the preparation of replacement stator vanes which must be ground to a particular angle depending upon their intended position within the turbine engine.

It is therefore an object of this invention to provide a grinder assembly for grinding stator vanes which is portable and therefore easily operational in the field.

It is another object of this invention to provide a portable grinder assembly which is easily operated and meets maximum safety standards.

It is a further object of this invention to provide a portable grinder assembly which greatly reduces the time involved in properly sizing the vanes.

It is still a further object of this invention to provide a portable grinder assembly which is economical to produce and which utilizes conventional, currently available components that lend themselves to standard mass producing manufacturing techniques.

For a better understanding of the present invention, together with other and further objects thereof, reference is made to the following description taken in conjunction with the accompanying drawing and its scope will be pointed out in the appended claims.

DETAILED DESCRIPTION OF THE DRAWING

FIG. 2 is a plan view of the portable grinder assembly of this invention; and FIG. 3 is a bottom view of the portable grinder assembly of this invention.

DETAILED DESCRIPTION OF THE PREFERRED EMBODIMENT

Figure 1:
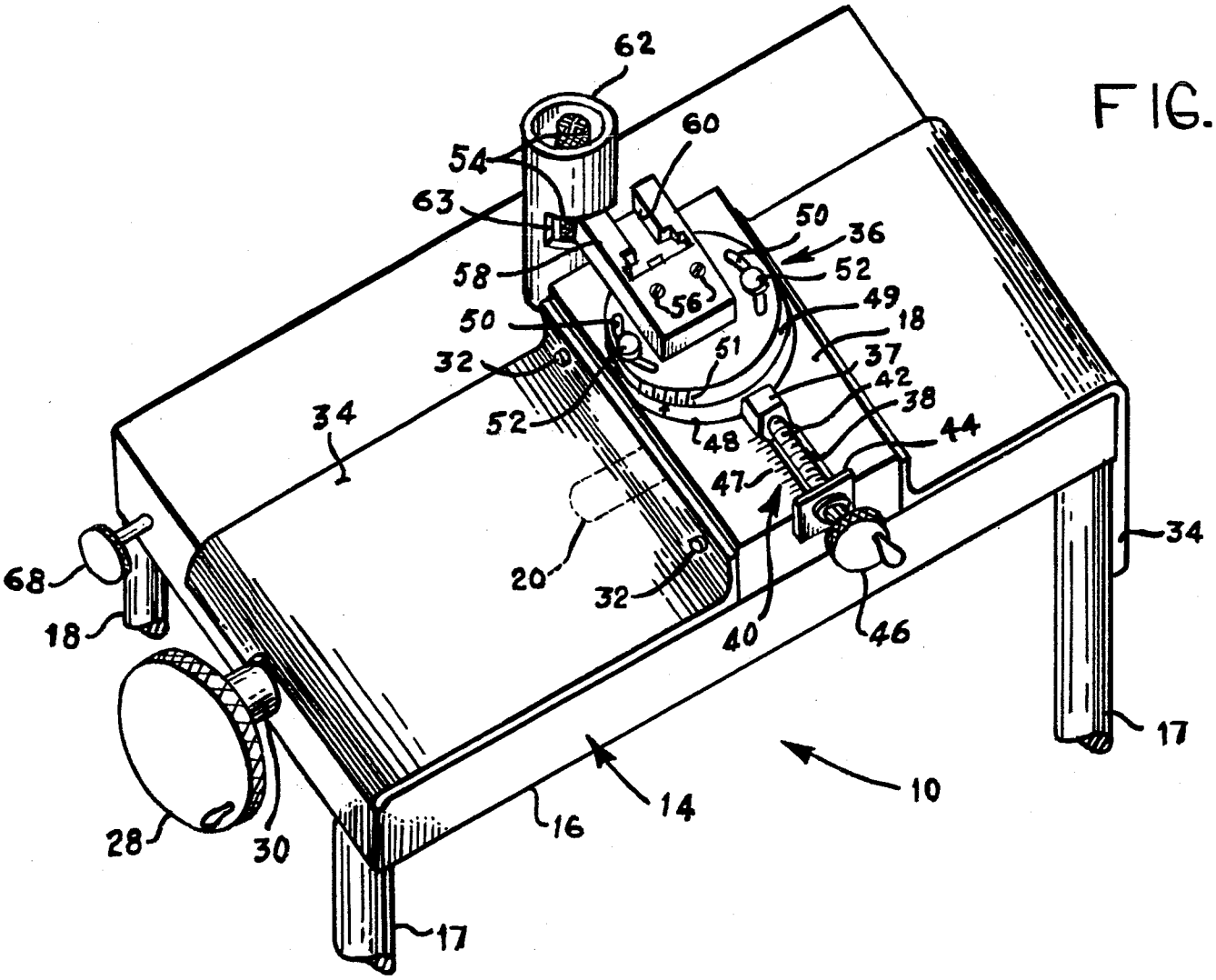
FIG. 1 is a pictorial representation of the portable grinder assembly of this invention.

Reference is now made to FIGS. 1 and 2 of the drawing which clearly illustrate the major compenents of the portable grinder assembly 10 of this invention. It should be realized that although the following description will include therein specific reference to a replacement stator vane 12, the grinder assembly is not limited to the grinding of stator vanes 12 but may be utilized, under certain circumstances, for the grinding of other types of elements.

As clearly illustrated in the drawing, assembly 10 is made up of a main support structure 14 which is preferably of a table-like or bench-like configuration having a substantially flat base 16 and a plurality of supporting legs 17. Although this invention is not limited to specific dimensions, it should be realized that for the purpose of accommodating in-the-field operation support structure 14 should be dimensioned so that grinder assembly 10 may be portable.

Situated upon base 16 and slidable in the longitudinal direction thereon is a work mount 18. Work mount 18 as clearly shown in FIGS. 1 and 3 of the drawing is positioned above a longitudinal slot 20 situated in base 16. An internally threaded retainer 22 is secured to the bottom of mount 18 and protrudes through slot 20. Retainer 22 is threadable upon an elongated rod 24 also having threads 26 at one end thereof and a suitable cranking element 28 at the other end thereof. Rod 24 is held in appropriate position with respect to base 18 by passing through a support block 30 either fixedly secured to base 16 or formed as an integral part. The appropriate rotation of crank 28 will therefore move mount 18 in the longitudinal direction with respect to base 16.

Since grinder assembly 10 of this invention is used for cutting purposes, it is desirable to fixedly secure by any suitable fastening means such as bolts 32, a pair of thin sheets or covers 34 to each side of mount 18. The purpose of sheet cover 34, which is preferably made of a thin elastic material, is to preclude any of the grinding material or dust from falling through slot 20 and damaging the mechanism for moving mount 18. As shown in FIG. 1 of the drawing sheet 34 may be made of such a length as to completely cover slot 20 when mount 18 moves to its fullest extent in either direction.

Slidably supported upon mount 18 for movement in a direction transverse to the longitudinal direction of slidable mount 18 is a two piece fixture holder 36. Holder 36 has a guide 37 secured to or formed as an integral part of the bottom thereof. Guide 37 is slidable within a slot 38 located in mount 18 and positioned in a direction transverse to the direction of longitudinal slot 20. Any suitable driving mechanism 40 capable of moving holder 36 in this transverse direction is operably connected at one end thereof to holder 36 and at the other end to mount 18. As shown in the FIGS. of the drawing, a typical mechanism 40 which can be utilized for this purpose is a threaded rod 42 passing through a threaded aperture in guide 37 and being rotatably supported on mount 18 in any conventional manner such as by element 44. A crank 46 is attached to end 45 of rod 42 so that rotation thereof causes this transverse movement of holder 36 to take place. Any suitable scale 47 can be marked adjacent mechanism 40 so one can quickly and accurately determine the amount of movement of holder 36.

As shown in FIG. 1, holder 36 is made preferably of two cylindrically-shaped elements 48 and 49 slidably rotatable with respect to each other. Element 49 has a pair of semi-circular slots 50 positioned therein about the central axis thereof with any suitable holding means such as bolts 52 protruding therethrough and being securable at the ends therof to element 48. In this manner loosening of bolts 52 will allow manual rotation of element 49 with respect to element 48 to be performed so as to accurately position a stator vane 12 adjuacent a cutter 54 in a manner to be described in detail hereinbelow. A scale 51 can be utilized in conjunction with elements 48 and 49 in order to record the angular rotation of element 44.

Removably secured by any suitable securing means such as bolts 56 to element 49 of holder 36 is stator vane fixture 58. Fixture 58 has a cut-out portion 59 therein which is configured to accommodate stator vane 12. A variety of fixtures 58 may be used with holder 36 so that a plurality of differently shaped vanes may be ground by this invention. Any suitable Allen-type screw or other holding means 60 is adjustably mounted in fixture 58 and located adjacent vane 12 when in place in order to securely hold stator vane 12 in position for grinding.

Adjacent fixture 58 and secured to base 18 is a cylindrically-shaped housing 62 which encompasses therein cutter 54 to be described further below. A slot 63 is formed in housing 62 adjacent fixture 58 so that stator vane 12 can contact cutter 54 as fixture 58 passes adjacent cutter 54. The movement of stator vane 12 across cutter 54 is accomplished by the rotation of crank 28 thereby sliding mount 18 in the longitudinal direction adjacent cutter 54. Cutter 54 is preferably a half inch diameter carbide cutter which protrudes through an opening in base 16 so as to be conveniently powered by any suitable air driven grinder 64 (shown in FIG. 3) such as model 8212B manufactured by the Aro Corporation of Bryan, Ohio. Any suitable air supply may be attached to air inlet 66 for operating air grinder 64. Housing 62 which encompasses cutter 54 not only serves as a safety shield during grinding of stator vane 12 but also acts as a duct to ensure that cooling air bathes the cutting surface during the grinding operation. The operation of grinder 64 can be regulated by any suitable on/off switch 67 which is attached thereto and controlled by knob 68 mounted in any suitable manner to base 16.

MODE OF OPERATION

The portable grinder assembly 10 of this invention can be brought to the appropriate field position when it is necessary to replace worn stator vanes 12 from a turbine engine. Standard oversized stator vanes 12 which are readily available can be accurately ground to the appropriate dimensions by the use of this invention. An oversized vane 12 is positioned within cutout portion 60 in fixture 58 and fixedly secured therein by means of screw 60 with the mount 18 in a position removed from cutter 54. Thereafter appropriate adjustment of cranks 28 and 46 positions vane 12 so as to come in contact with the cutter 54. The specific angle of cut is determined by the amount of rotation between elements 48 and 49 of fixture holder 36. The amount of material to be removed from vane 12 is determined by the position of holder 36 with respect to cutter 54 as determined by the rotation of crank 46. Grinder 64 is activated by means of on/off knob 68 and the stator vane is slowly drawn across cutter 54 by the rotation of crank 28. This operation can be performed manually and may be stopped at anytime during the operation to check for the accuracy of the cut.

With the utilization of the portable grinder assembly 10 of this invention stator vane repair can be made quickly, in-the-field and in an extremely accurate manner. The grinding of one stator vane by the use of the present invention can be accurately completed in approximately two minutes time. Such an operation is a substantial improvement over devices which have been used in the past.

Although this invention has been described with reference to a particular embodiment, it will be understood that this invention is also capable of further and other embodiments within the spirit and scope of the appended claims.

We claim:

1. A portable grinder assembly for use in grinding a component to a preselected size, said grinder assembly comprising:

a main support;

means operably connected to said main support for grinding said component, said grinding means including a vertically upstanding grinding element and air powered means for rotating said grinding element about is vertical axis;

means slidably mounted on said main support for positioning said component adjacent said grinding element and for permitting said component to be moved in three predetermined directions, said component positioning means including a fixture, said fixture containing a cut-out portion therein configured to accept an end of said component and for removably securing said component therein, first means connected to said fixture for permitting movement of said component to take place in a first predetermined direction and a second predetermined direction, and second means connected to said first movement permitting means for permitting movement of said component to take place in a third predetermined direction;

said first movement permitting means including a pair of elements, one of said elements being slidably mounted upon said second movement permitting means for permitting movement of said component to take place in said first predetermined direction and the other of said elements being slidably mounted upon said one element for permitting movement of said component to take place in said second predetermined direction;

said second movement permitting means being slidably mounted upon said main support for permitting movement of said component to take place in said third perdetermined direction and means operably connected to said second movement permitting means for moving said second movement permitting means a preselected distance;

said main support having an elongated, longitudinally extending slot formed therein adjacent said second movement permitting means, said means for moving said second movement permitting means having a portion thereof extending through said slot;

said second movement permitting means having means operably connected therewith for completely covering said slot in order to prevent grinding dust from entering said slot, said slot covering means including a pair of thin elastic sheets, each of said sheets being attached at one end thereof to said second movement permitting means, and each of said sheets simultaneously, continuously, completely covering said slot;

means encompassing said grinding element for cooling said component and said grinding element and protecting an operator of said grinder assembly from injury during operation thereof, said cooling and protecting means including an upstanding, cylindrically-shaped tube surrounding said vertically upstanding grinding element, said tube having a slot therein permitting said component to pass therethrough adjacent said grinding element; and wherein said first predetermined direction is along a line transverse to said longitudinally extending slot, said second predetermined direction is about an axis perpendicular to the surface of said main support, and said third predetermined direction is along a line coincidential with said longitudinally extending slot.

2. A portable grinder assembly as defined in claim 1 wherein said component is made up of an oversized replacement stator vane.

* * * * *